United States Patent [19]

Braun et al.

[11] 3,992,633

[45] Nov. 16, 1976

[54] BROAD APERTURE X-RAY GENERATOR

[75] Inventors: Martin Braun; Howard D. Doolittle, both of Stamford, Conn.

[73] Assignee: The Machlett Laboratories, Inc., Springdale, Conn.

[22] Filed: Dec. 9, 1974

[21] Appl. No.: 530,793

Related U.S. Application Data

[63] Continuation of Ser. No. 393,771, Sept. 4, 1973, abandoned.

[52] U.S. Cl. ..... 250/503; 250/505

[51] Int. Cl.[2] ..... H01J 35/16

[58] Field of Search ..... 250/403, 419, 420, 510, 250/503, 505; 313/330

[56] References Cited

UNITED STATES PATENTS

| | | | |
|---|---|---|---|
| 2,531,583 | 11/1950 | Ott | 250/403 |
| 2,535,708 | 12/1950 | Vlach | 250/419 |
| 3,171,029 | 2/1965 | Boucher | 250/419 |
| 3,171,030 | 2/1965 | Foster et al. | 250/403 |
| 3,239,706 | 3/1966 | Farrell et al. | 313/330 |
| 3,502,877 | 3/1970 | Splain | 250/403 |
| 3,517,195 | 6/1970 | Leavitt | 250/419 |
| 3,662,210 | 5/1972 | Maximov | 313/330 |
| 3,668,454 | 6/1972 | Shimura | 313/330 |
| 3,867,637 | 2/1975 | Braun et al. | 250/505 |
| 3,894,239 | 7/1975 | Braun | 250/493 |

*Primary Examiner*—Alfred E. Smith
*Assistant Examiner*—B. C. Anderson
*Attorney, Agent, or Firm*—David M. Warren; Joseph D. Pannone; Milton D. Bartlett

[57] ABSTRACT

An extended radiating aperture for X-rays is provided by means of a stationary target of an X-ray emissive metal positioned for uniform illumination by high speed electrons emanating from a cathode and accelerating through a difference of potential between the cathode and the target. The target is in the form of a relatively thin film which can be deposited on a substrate transparent to X-radiation. The substrate cools the target. The generator is advantageously utilized with a zone plate which provides a coding on a roentgenogram which is then decoded by an optical processor to form a visible image of an object being X-rayed. An alternative embodiment of the invention includes the use of an inclined transmissive target for enhanced monochromaticity to emitted radiation.

3 Claims, 9 Drawing Figures

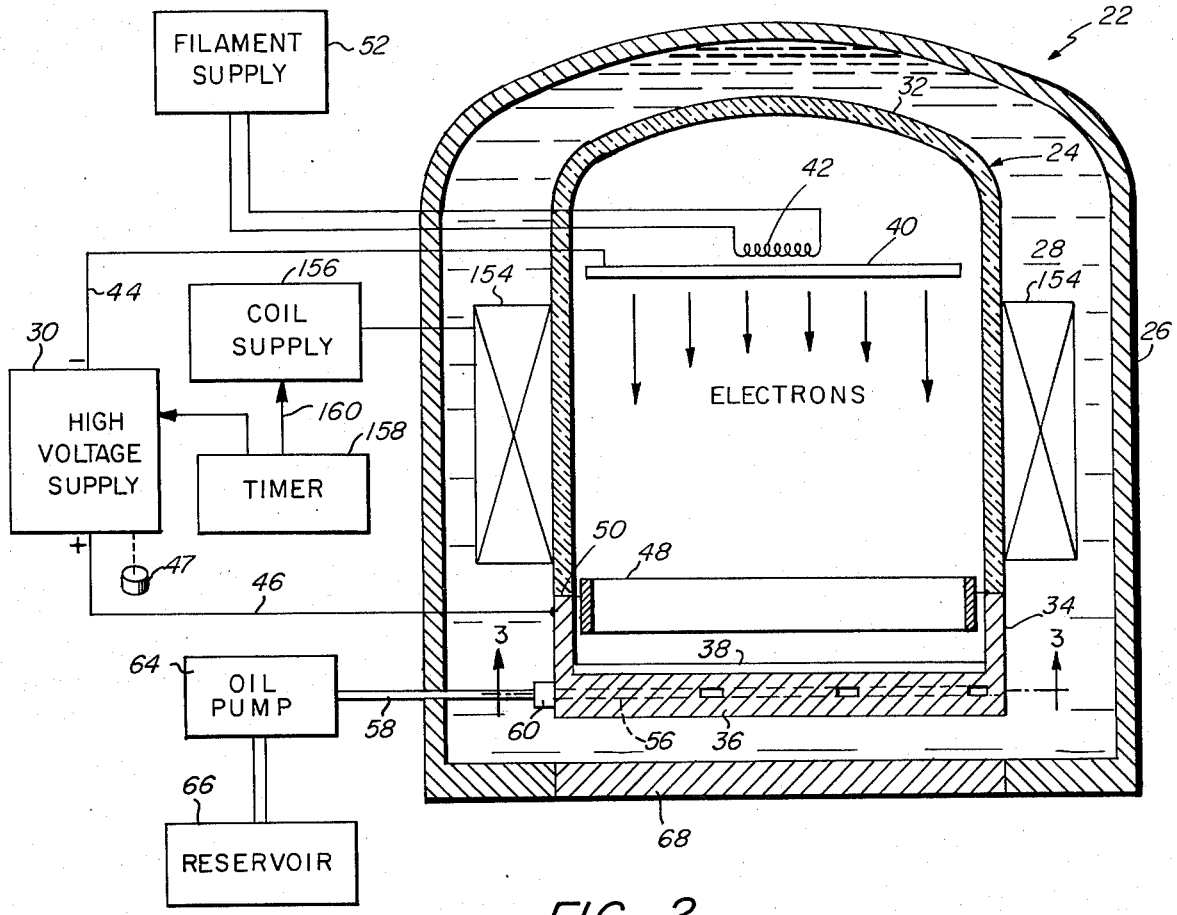
FIG. 2
FIG. 3
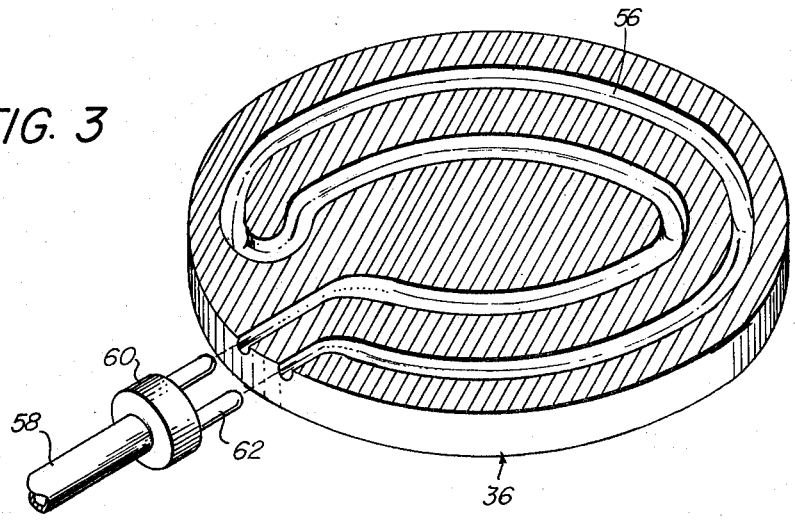

BROAD APERTURE X-RAY GENERATOR

Cross-Reference to Related Cases

This is a continuation of application Ser. No. 393,771, filed Sept. 4, 1973, abandoned.

BACKGROUND OF THE INVENTION

Roentgenography frequently requires that intense x-radiation be provided over a relatively short interval of time, for example, one-tenth second or less in the case of an angiogram to prevent blurring of the image due to motion of the blood vessels of a human subject. For radiograms of the human skeleton, longer exposure times can be accommodated so long as the patient can remain stationary. Shorter exposure times require the use of higher intensity radiation for good quality images on the photographic plate since the total incident energy required to produce the image on the photographic plate is approximately the same for both short and long exposure times. A problem arises in that there is a limited intensity of radiation that can be provided by the typical rotating anode target of an X-ray tube because of overheating of the target at the point of impact of an electron beam upon the target. This problem is further intensified by the fact that high resolution radiography requires that the target emit the X-rays from a relatively small spot, typically less than ten square millimeters, thereby increasing the temperature of the target.

SUMMARY OF THE INVENTION

The aforementioned problems are overcome and other features are provided by an X-ray source or generator in accordance with the invention wherein there is provided an X-ray tube comprising a source of high energy electrons and a relatively thin transmissive target illuminated on one side thereof by the electrons and emitting X-rays from the surface of the target opposite the side which is illuminated by the electrons. In one embodiment of the invention, a surface of the target is inclined relative to an exit window of the X-ray tube to augment the percentage of fluorescent X-rays which are generated by the target relative to the total spectrum of X-rays emitted by the target. This provides enhanced monochromaticity to the X-rays propagating through the window of the X-ray tube. Cooling of the target is provided by a substrate which is thermally conductive and transparent to X-radiation.

As an example in the use of the generator for roentgenographic purposes, it is most desirable to provide a large spectral bandwidth to the spatial frequency characteristic of the radiation emitted by the target. This may be accomplished with a zone plate, such as that disclosed in U.S. Pat. No. 3,748,470 which issued on July 24, 1973 to Harrison H. Barrett having a chipped checkerboard pattern or, alternatively, a zone plate in the form of an off-axis Fresnel pattern, which is utilized to spatially modulate the emitted X-radiation. A system for using the generator of this invention is also disclosed in a copending application, Ser. No. 393,772, U.S. Pat. No. 3,867,637 by Martin Braun et al. entitled "Extended Monochromatic X-Ray Source." The x-ray tube may include means for attaching a zone plate or other spatial filter thereto for modulating or filtering the X-radiation. The X-ray tube with the zone plate attached thereto is then positioned for directing the X-radiation towards a patient behind which is a standard photographic plate commonly used in roentgenography. A coded photograph of the internal structure of the subject is obtained in view of the coding provided by the zone plate. The photograph on the X-ray plate is first decoded in order to provide an intelligible image which may be viewed by a radiologist for observing the internal structure of the subject. In the case of the off-axis Fresnel pattern zone plate, the decoding of the photograph, or reconstruction of the image, is readily accomplished by a relatively simple optical system employing an off-axis iris and telescope. A random pattern zone plate may also be used. There is also disclosed a half-tone screen which is placed between the zone plate and the subject for spatially modulating the subject as viewed by the incident radiation, thereby making the subject appear as a high spatial frequency subject which is more accurately photographed in this zone plate system.

BRIEF DESCRIPTION OF THE DRAWINGS

The aforementioned aspects and other advantages of the invention are explained in the following description taken in connection with the accompanying drawings wherein:

FIG. 2 is an embodiment of the X-ray generator of FIG. 1 in accordance with the invention;

FIG. 3 shows a fluid cooled substrate for the target of the generator of FIG. 2;

DESCRIPTION OF THE PREFERRED EMBODIMENT

Figure 1:
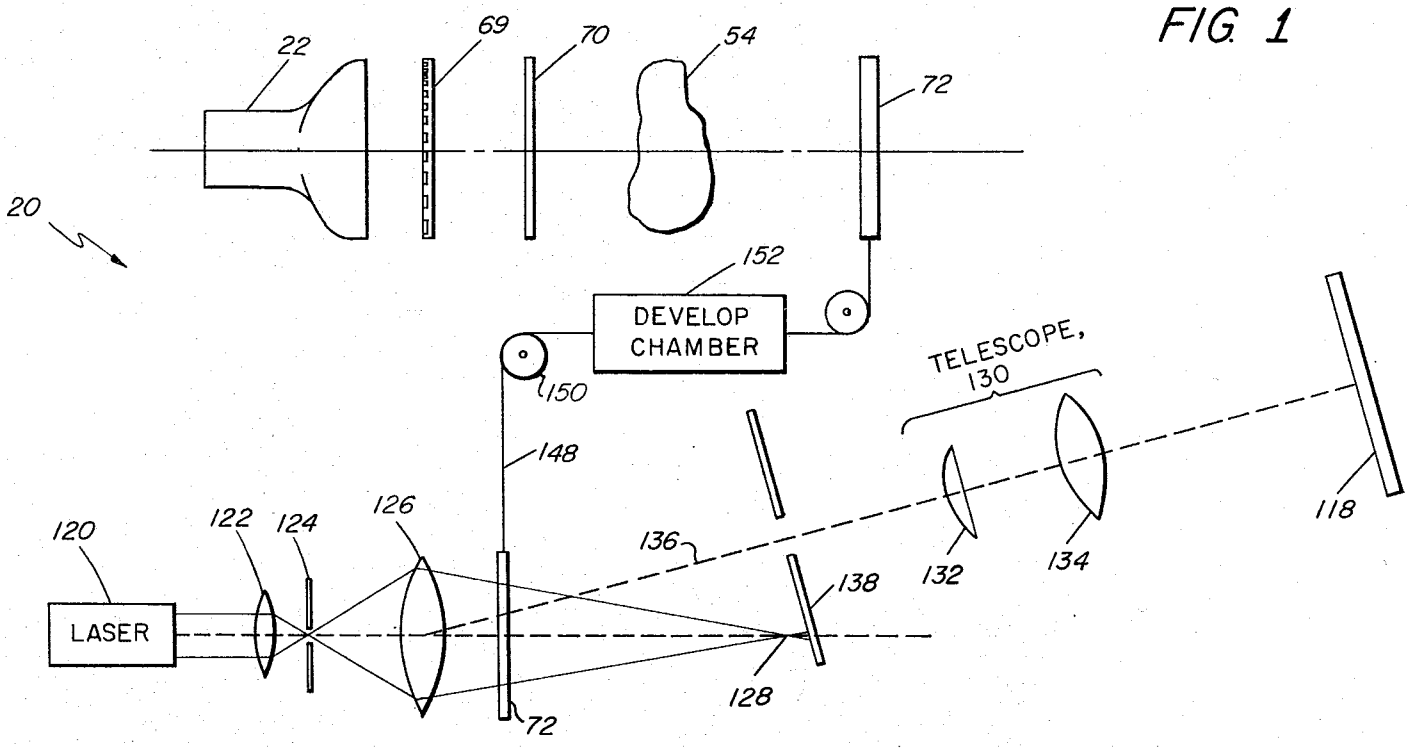
FIG. 1 shows an X-ray imaging system suitable for use with the broad aperture generator of the invention.

Referring now to FIGS. 1 and 2 there is seen a system 20 which, in accordance with the invention, includes a generator 22 of X-rays. As seen in FIG. 2, the generator 22 comprises an X-ray tube 24 which is enclosed by a housing 26 and immersed in oil 28 which is enclosed by the housing 26 and serves as insulation from the high voltage electric power which is provided by a power supply 30. The X-ray tube 24 comprises a glass envelope 32 which is sealed to a metallic base 34 which includes a substrate 36 for maintaining a vacuum-tight region within the X-ray tube 24. A thin target 38 extends across the width of the X-ray tube 24 and, thus, has a width many times greater than its depth. The target 38 has the form of a thin foil or film of a heavy X-ray emitting element, such as tungsten or gold, or material comprising a lighter X-ray emitting element, such as cerium or molybdenum, is deposited on the substrate 36 within the evacuated region of the X-ray tube 24. The target 38 is known as a transmissive target since it is thin enough to permit X-rays generated on one surface to pass through to the opposite surface.

While the substrate 36 is utilized for supporting the target 38, the invention contemplates other means of support such as a frame (not shown) attached to the periphery of the target 38 when the target 38 is in the form of a foil. The use of the substrate 36 is preferred as it helps cool the target 38. A cathode 40 is heated by a filament 42 and is provided with a large enough area to illuminate the entire target 38. The cathode 40 emits electrons which travel in substantially parallel paths under the influence of a difference of electric potential established between the cathode 40 and the target 38 by means of the power supply 30 connected thereto by wires 44 and 46. A knob 47 connects with the power supply 30 to adjust the voltage between the wires 44 and 46 for selecting the energy of the X-rays. A shield 48 is provided adjacent the seal 50 between the glass envelope 32 and the metallic base 34 to protect the seal 50 from electrons emitted from the cathode 40.

The substrate 36 is perferably constructed of a light metal such as aluminum or beryllium which is essentially transparent to X-rays emitted by the target 38 while being adequately rigid to retain the target 38 in position and to overcome the pressure of the atmosphere acting against the vacuum within the X-ray tube 24. The filament 42 is energized with electric current from a filament supply 52, the filament 42 being energized prior to the operation of the generator 22 for heating the cathode 40 prior to the application of a pulse of energy from the power supply 30. This pulse of energy is provided with a time duration commensurate with the voltage of the power supply 30 and the thickness and composition of a subject 54, in FIG. 1, which is to be photographed by the system 20. The target 38 is thin enough, on the order of one-half mil, so that X-rays emitted from its top surface can pass through the target 38 towards the subject 54; the target 38 is thick enough to stop the incident electrons. A window 68, which is composed of a low atomic number material such as aluminum, which is transparent to X-rays is mounted at one end of the housing 26 for retaining the oil 28 within the housing 26 while permitting the propagation of radiation from the X-ray tube 24 to the subject 54.

The use of the target 38 and substrate 36 provides for simplicity in mechanical design since the well-known rotating anode is not required. In addition, the thin depth of the target 38 coupled with the good thermal conductivity of the substrate 36 provides increased cooling of the target 38 and greater power handling capability over other forms of X-ray tubes. The cooling capacity of the substrate 36 can be increased by circulating a fluid such as oil along a conduit 56 within the substrate 36 as shown in FIGS. 2 and 3. FIG. 3 shows a sectional view of the substrate 36 taken along the line 3—3 of FIG. 2 to expose the conduit 56. The substrate 36 is conveniently manufactured by providing two disks, one of which is milled to form the conduit 56 as shown in FIG. 3, after which the two disks are joined as by bonding, brazing or bolting. The ends of the conduit 56 are coupled to a cable 58 having a pair of passages by a plug 60 having a pair of nipples 62 which mate with the ends of the conduit 56, the cable being coupled to a pump 64 which pumps oil from a reservoir 66 to the substrate 36.

Figure 4:
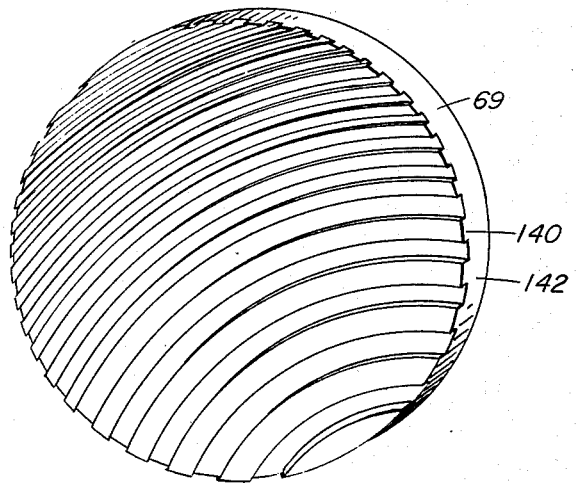
FIG. 4 shows a Fresnel zone plate for use with the generator of FIG. 2.
Figure 5:
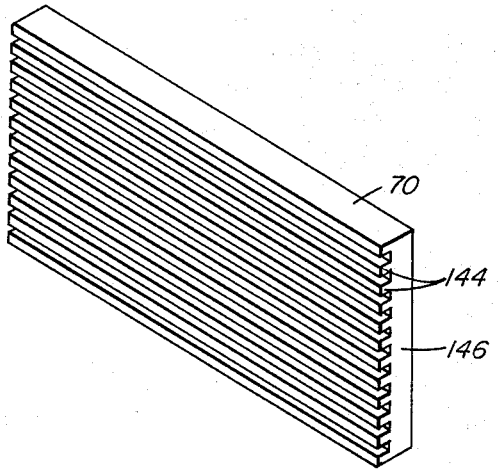
FIG. 5 shows a half-tone screen for use with the generator of FIG. 2.

As seen in FIG. 1, a zone plate 69 and a half-tone screen 70, which are further shown in FIGS. 4 and 5, are positioned along the axis of and external to the generator 22. The screen 70 is positioned between the zone plate 69 and the subject 54, the position of the screen 70 being closer to the subject 54 than to the zone plate 69, for presenting to the incident radiation a modified view of the subject 54 which is seen to be apparently broken up into small regions analogous to a mosaic which has a relatively high spatial frequency spectrum. Such a spectrum cooperates advantageously with the zone plate 69 to provide a superior image than does the low spatial frequency spectrum associated with the subject 54. The rays of X-radiation as modulated by the zone plate 69, the screen 70 and the subject 54 impinge upon a photographic plate 72 for providing a coded image similar to a hologram on the photographic plate 72.

As an example of the use of the system 20, it is convenient to consider the situation where angiography is utilized for examining a human subject in which case the subject 54 would be that portion of the human subject under observation. In angiography, a dye such as iodine is commonly administered to the patient for purposes of absorbing X-radiation to better define the shadow cast by an organ or blood vessel as compared with the shadow of other tissue which has absorbed a differing amount of the iodine dye. In this situation, cerium or an oxide thereof known as ceria is chosen for use in the target 38 based on the fact that the X-ray emission spectrum of cerium advantageously matches the absorption spectrum of iodine. The fluorescent emission lines of cerium (resulting from an electron of an outer shell of the cerium atom falling into a void in an inner shell due to bombardment by electrons from the cathode 40) occur at essentially the peak of the X-ray absorption curve for iodine in the well-known graphical portrayal of the X-ray absorption of iodine as a function of the energy in electron volts of the radiation to be absorbed. In this way, the choice of cerium in the target 38 and iodine in the subject cooperate to provide a well-defined image of the patient, the definition being due to the monochromaticity of the radiation incident upon the patient and the choice of the energy or frequency of the incident radiation to be equal to the energy or frequency at the peak of the absorption spectrum of the dye which has been administered to the patient.

Figure 6:
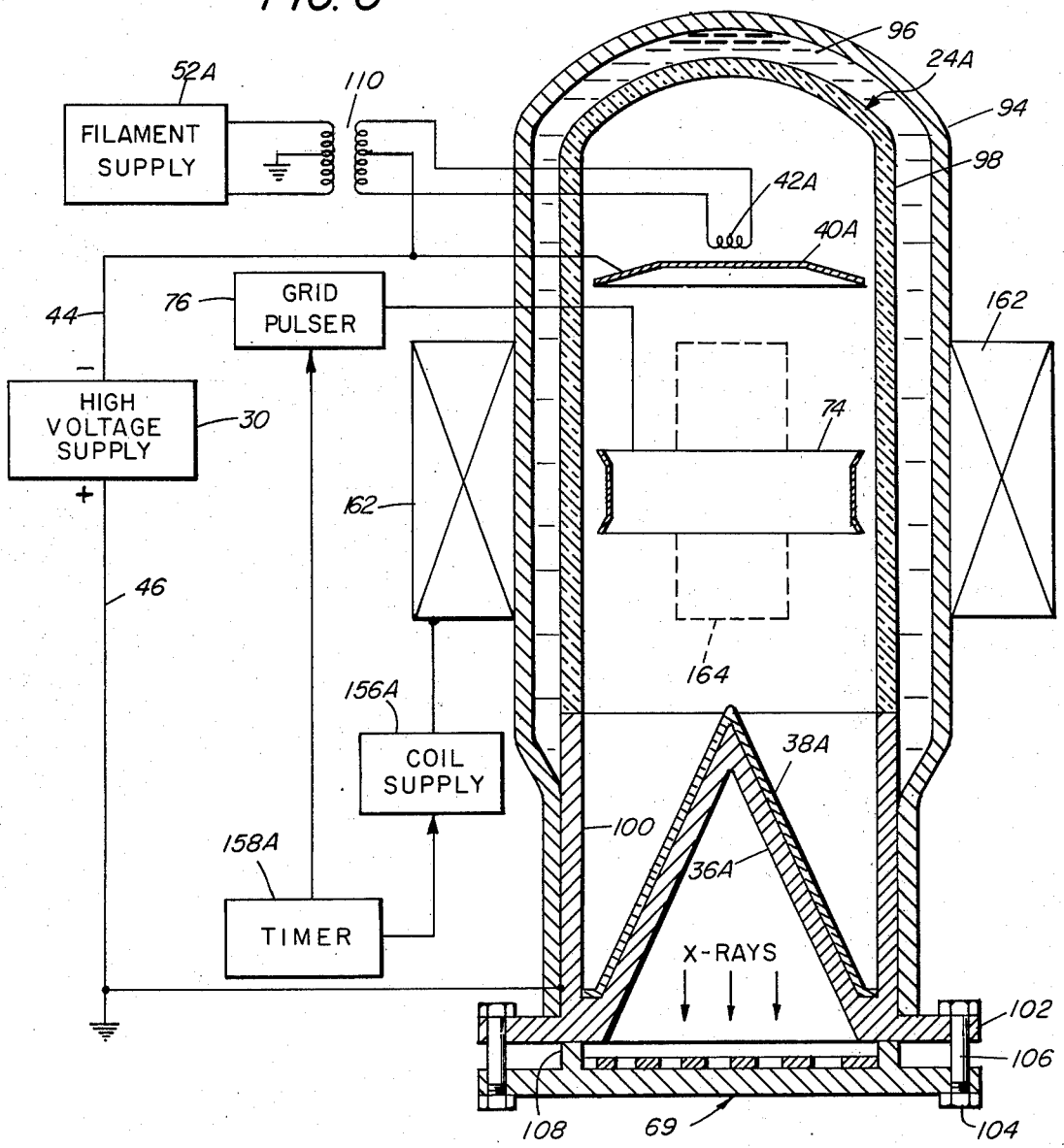
FIG. 6 shows an embodiment of the generator having a target with a surface inclined to the axis of an exit beam of radiation in accordance with the invention.

Referring now to FIG. 6 there is seen an alternative embodiment of the X-ray tube 24 of FIG. 2, this embodiment being designated by the legend 24A. The X-ray tube 24A is seen to comprise a non-contacting grid 74 having the form of an annulus or cylinder with its axis coinciding with the axis of the tube 24A. The filament 40 of FIG. 1 is here modified as shown by the filament 40A to provide for paths of emission of electrons which are more readily directed by the grid 74 to uniformly illuminate a target 38A which is seen to be deposited on a substrate 36A. The diameter of the grid 74 is approximately equal to the spacing of the grid 74 from the cathode 40A. Use of the grid 74 provides better control over the beam modulation to provide sharper pulses since the power supply 30 is no longer required to pulse on and pulse off the high voltage between the cathode 40A and the target 38A. A well-known circuit indicated as grid pulser 76 is utilized for applying a difference of potential between the cathode 40A and the grid 74 to accomplish a modulation of the beam of electrons.

The X-ray tube 24A is enclosed within a housing 94, typically of lead to confine the X-radiation, with an electrically insulating layer of oil 96 interposed between the housing 94 and a glass envelope 98 of the X-ray tube 24A. The housing 94 extends to the base of the substrate 36A to confine the emitted radiation in the direction of the zone plate 69. The substrate 36A is sealed to the envelope 98 and forms a part of the base 100 of the X-ray tube 24A. The base 100 is utilized in sealing off the chamber of oil 96 so that flanges 102 may be mounted externally to the housing 94 to permit mounting of the zone plate 69 with the aid of nuts 104 and bolts 106 which urge a bezel 108 surrounding the zone plate 69 toward the base 100. The wires 44 and 46 couple the power supply 30 respectively to the cathode 40A and the base 100 in a manner analogous to that utilized in connecting the power supply 30 in FIG. 2. In FIG. 6, the wire 46 is grounded so that the base 100 and the target 38A are also at ground. This permits attachment and detachment of the zone plate 69 whenever desired by an operator of this equipment as may be required for examining various parts of human patients. Since the difference of potential provided by the power supply 30 may be as high as 150 kilovolts, an especially designed filament transformer 110 which is sufficiently insulated to withstand 150 kilovolts between its primary and secondary windings is utilized for coupling a filament supply 52A to the filament 42A. The center tap of the primary winding of the transformer 110 is grounded while the center tap of the secondary winding of the transformer 110 is coupled to the high voltage on wire 44.

The target 38A and the substrate 36A both have surfaces inclined at an angle to the axis of the tube 24A. Radiation directed outwardly from the tube 24A is emitted from the target 38A at an angle to its surface, such an angle being preferably on the order of 80° to 85° relative to a normal to that surface. As will be disclosed with reference to FIGS. 8 and 9, the spectra of radiation emitted from the surface of the target 38A varies with the angle of observation of the radiation relative to the surface from which the radiation is emitted. As will be seen, X-radiation emitted at glancing angles of approximately 5° to 10° contains a higher percentage of the fluorescent X-ray lines relative to the entire spectrum of the X-radiation than is the case with radiation observed at other angles relative to the surface of the emitting target. Also, bremsstrahlung generated within the target 38A is attenuated in the axial direction because of the increased depth of the target material as measured along the tube axis. This further reduces the amount of bremsstrahlung reaching the zone plate 69. Accordingly, the observed radiation, which is seen at an orientation substantially parallel to the axis of the tube 24A, is of enhanced monochromaticity which, as has been discussed earlier, is most useful for roentgenography.

The target 38A is composed of a 20–40 micron thick layer of a material composed of the lower atomic numbered X-radiating elements such as cerium or molybdenum which produce a more pronounced K-emission line than a high atomic numbered element such as tungsten. This results in a higher intensity of the softer X-rays, typically 34 keV as used in angiography, being produced directly in response to electron bombardment of the target 38A than is obtained with the target 38 of FIG. 2. For example, in the case of a 20 micron thick layer of molybdenum, the *ka* emission lines are at 17.5 keV. With illumination by 35–40 keV electrons, more than 95% of the total radiation is concentration in the range 14–20 keV photon energy. Illumination of a 40 micron thick layer of cerium with 70 keV electrons generates a spectrum, as viewed at an angle of 80° relative to a normal to the surface of the cerium layer, which contains 70° of its energy in the range 33–40 keV. This cerium emission spectrum corresponds to the maximum absorption region of the iodine spectrum thus making iodine an ideal radiographic dye for use with a cerium X-ray source.

The inclining of the surfaces is accomplished in the tube 24A by providing the substrate 36A and the target 38A with a conical shape. It is noted that the inclined surface of the target 38A has the further advantage of enlarging the total area illuminated by the electrons from the cathode 40A with the result that a greater intensity of X-rays is produced.

Returning to FIG. 1, the system 20 is seen to include an optical system 116 utilized in reconstructing an image on a screen (or film plate) 118 from the coded photograph or hologram on the film plate 72. The optical system 116 comprises a light source 120, which is advantageously a laser providing coherent illumination, a converging lens 122 which converges the rays of light through an iris 124 whereupon they impinge upon a second converging lens 126 which brings the light rays to a focus at focal point 128. The photographic plate 72 is developed and then placed behind the lens 126 so that the rays of light exiting from the lens 126 pass through the photographic plate 72 on their way to the focal point 128. A telescope 130 comprising plano-convex lens 132 and converging lens 134 is angled along axis 136 relative to the axis of the lens 126. The telescope 130 observes diffracted light passing in the general direction of the axis 136 and through an iris 138 to image this light upon the screen 118. The optical system 116 is utilized for decoding images formed with a zone plate 69 having the form of an off-axis Fresnel pattern. If a zone plate utilizing some other modulation pattern is employed in the system 20 another form of decoding or matched filtering such as that disclosd in the aforementioned patent to Barrett is utilized. The orientation of the telescope 130 along the angled axis 136 corresponds with the off-axis focusing of an off-axis Fresnel plate. The light which is brought to focus at the focal point 128 is blocked by the opaque portion of the iris 138 so as to form no portion of the reconstructed image on the screen 118. As is apparent from FIG. 1, the use of an off-axis Fresnel pattern zone plate provides a coded image on the photographic plate 72 which can be advantageously decoded with relativley few optical elements.

As seen in FIGS. 4 and 5, the zone plate 69 and the half-tone screen 70 may be formed by depositing a material containing lead upon a substrate. In FIG. 4 the deposited material 140 is supported by a substrate 142 of the zone plate 69; in FIG. 5 the deposited material 144 is supported by a substrate 146. In FIG. 1 the photographic plate 72 is shown being carried by a chain 148 past rollers 150 through a developing chamber 152 which develops the plate 72 and may also be provided with well-known means for reducing the size of the plate 72 to provide improved resolution.

Figure 7:
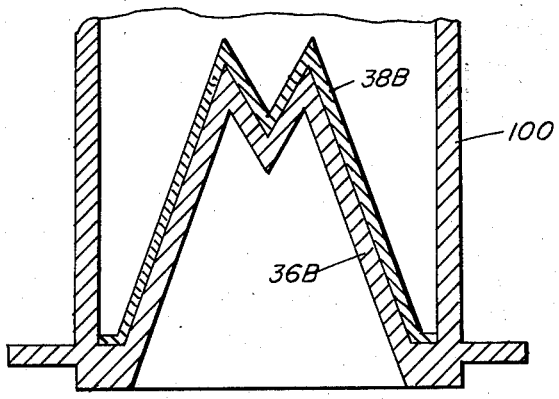
FIG. 7 shows a modification of the embodiment of FIG. 6 in which a conical target is shortened along its axis.

Referring now to FIG. 7, there is shown an alternative embodiment of the target 38A of FIG. 6 in which the length of the cone as measured along its axis is shortened by folding the apex of the cone inwardly along its axis, this embodiment of the substrate and target being referred to by the reference numerals, respectively, 36B and 38B. In this embodiment, the surfaces of the target 38B are inclined with respect to the axis of the target 38B just as the surface was inclined in the embodiment of FIG. 6. Accordingly, the same enhancement of monochromaticity is obtained since the radiation is viewed at a glancing angle to the surface of the target 38B. It is noted that this inclination of surface provides improved monochromaticity independently of whether the material of the target 38B be of the heavier radiating elements such as gold or tungsten, or whether they be of the lighter X-radiating elements such as cerium and molybdenum. Due to the strong fluorescent line in the spectrum of molybdenum and in the spectrum of cerium, the bombardment of these lower atomic number elements with electrons from the cathode 40A of FIG. 6 results in a far greater monochromaticity than is customarily obtained with gold or tungsten targets. The major portion of all the energy of the x-radiation is found to be produced by the K-emission lines of the molybdenum and the cerium targets. Accordingly, the X-ray tube 24A of FIG. 6, or the shorter version thereof as described in FIG. 7, provides a most suitable source of X-radiation for use with tracer dyes such as iodine in human subjects.

Good quality images can be obtained with the system 20 of FIG. 1 by uniformly illuminating the zone plate 69 with the X-radiation of the generator 22. One method of insuring such uniform illumination has already been disclosed in FIG. 6 with respect to the grid 74. Another means for obtaining such uniform illumination is to use magnetic focusing fields either singly or in conjunction with the grid 74. One such magnetic focusing system is illustrated in FIG. 2 wherein a magnet 154 which generates a magnetic field in the direction of the axis of the housing 26 is utilized. The magnet 154 is comprised of a coil which is energized by current from a coil supply 156 which is driven by a timer 158. The timer 158 applies signals along line 160 which cause the coil current to vary periodically during the same time interval at which the timer 158 is signaling the high voltage supply 30 to excite the X-ray tube 24. The periodic variation of the current in the coil of the magnet 154 results in a periodic spreading and contracting of the flux of electrons incident upon the target 38 which tends to balance out or neutralize any irregularities in the electron flux which may result from insufficient control of the electron flux by the electrostatic fields within the X-ray tube 24 or from nonuniform emission from the cathode.

An alternative embodiment for the control of the electron illumination of the target is shown by the pair of magnets 162 and 164 shown in FIG. 6. The magnets 162 and 164 are positioned for directing their magnetic fields perpendicularly to each other and within a plane perpendicular to the axis of the X-ray tube 24A. Current for these magnets is provided by a coil supply 156A in response to signals received from a timer 158A. The timer 158A signals the coil supply 156A to periodically vary the magnetic fields during the same interval of time that it is signaling the grid pulser 76 to turn on the electron beam within the tube 24A. The coil supply 156A provides currents of varying amplitudes to the magnets 162 and 164 and with the proper phasing between these currents to magnetically deflect the beam of electrons in either a raster scan or a spiral scan. This periodic deflection of the electron beam tends to smooth out any irregularities in the electron flux and thereby provides for a uniform illuminatin of the target 38A which in turn provides a uniform illuminatin of X-rays upon the zone plate 69.

Figure 8:
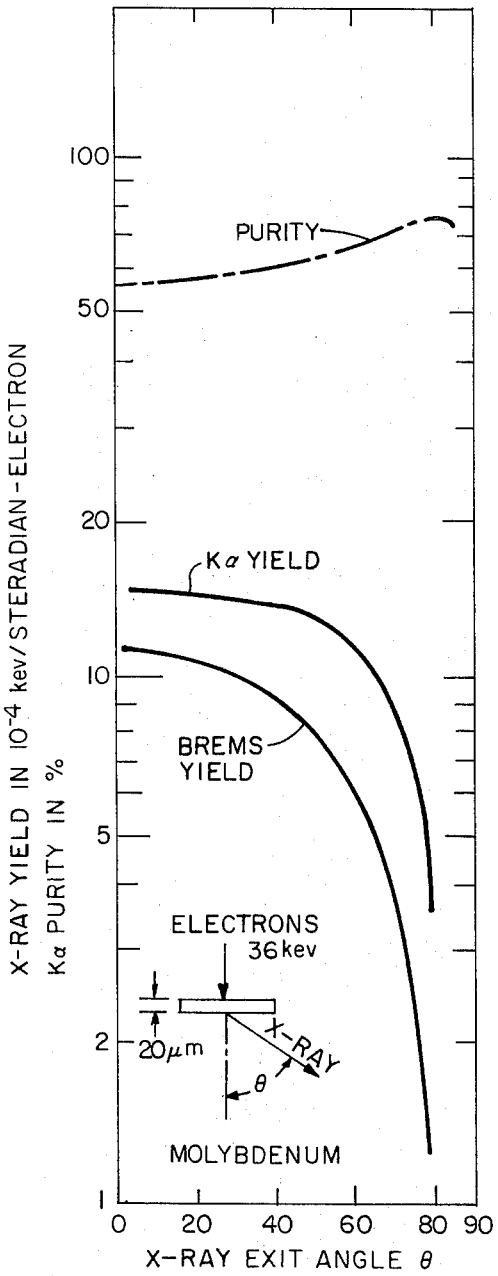
FIGS. 8 and 9 show the angular dependency of the purity and relative intensity of the emitted radiation of molybdenum and cerium targets for use in the system of FIG. 1.
Figure 9:
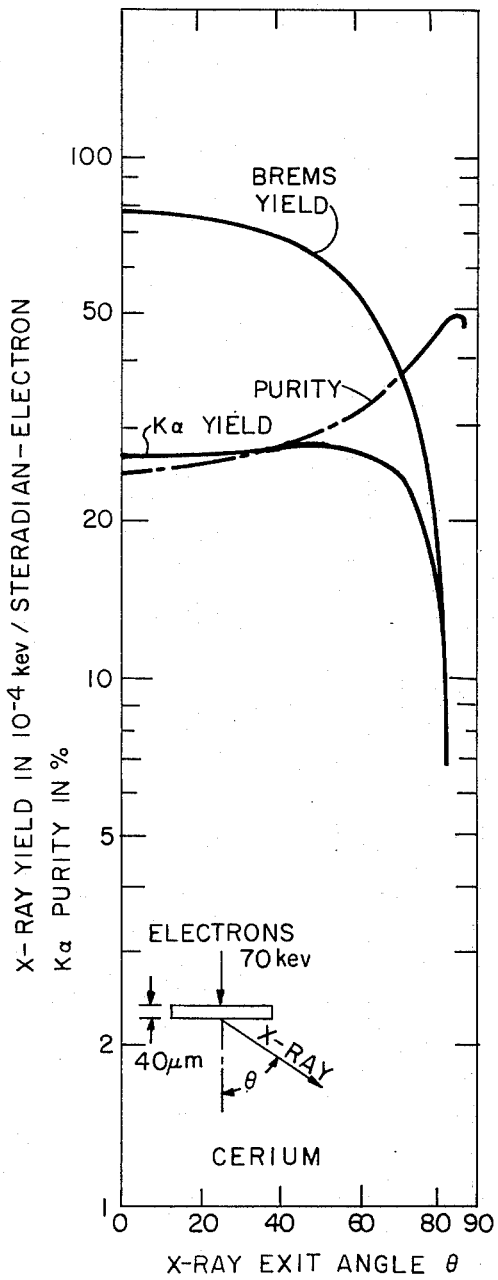

Referring now to FIGS. 8 and 9 there are seen graphs portraying the purity of the X-ray spectrum obtained from an X-ray target, such as the target 38 of FIG. 2 or the target 38A of FIG. 6, is a function of the viewing angle by which the emitted radiation is observed, the viewing angle being measured from the normal to the surface of the target. FIG. 8 represents data obtained for a target comprised of a 20 micron (micrometer) thick layer of molybdenum while FIG. 9 shows a similar graph obtained for a 40 micron thick layer of cerium. Also shown in FIGS. 8 and 9 are the intensity of the radiation of the $k_\alpha$ lines and the bremsstrahlung. The curve representing the purity represents the intensity measured at the $K_\alpha$ lines divided by the total intensity of the bremsstrahlung plus the $k_\alpha$ line radiations. It is noted that the purity curve peaks up in the range of approximately 80° to 85° and as was explained earlier with reference to FIGS. 6 and 7, this peaking effect on the purity curve is one of the reasons for inclining the surface of the target 38 relative to the axis of the X-ray tube. Thus, the purity curve is a measure of the monochromaticity of the emitted radiation.

The zone plate 58 of FIG. 1 having an off-axis Fresnel pattern utilizes a line spacing of approximately 50 lines per inch on the average. In situations where the half-tone screen 70 of FIG. 1 is positioned half way between the zone plate 58 and the photographic plate 72, the half-tone screen is provided with a line density of 100 lines per inch. To ensure an adequate density of line spacing on the half-tone screen for high quality images, the line density for the half-tone screen is obtained by the following formulation, namely, multiplying the average spacing density of the zone plate by a factor related to the relative spacings between the zone plate 58, the screen 70 and the photographic plate 72, this factor being the distance from the zone plate 58 to the plate 72 divided by the distance between the zone plate 58 and the half-tone screen 70. It is understood that the above above-described embodiments of the invention are illustrative only and that modifications thereof will occur to those skilled in the art. Accordingly, it is desired that this invention is not to be limited to the emobodiments disclosed herein but is to be limited only as defined by the appended claims.

What is claimed is:

1. An X-ray generator comprising:

a transmissive target having a width many times greater than its depth;

means for illuminating a first surface of said target with electrons of sufficient energy to excite X-ray emission from said target, at least a portion of said emission occurring from a second surface of said target opposite said first surface, said illuminating means being structured to uniformly illuminate said first surface of said target;

a substrate transparent to X-radiation positioned contiguous said second surface of said target for supporting said target in spaced relation to said illuminating means; and window means comprising a region transparent to x-radiation bounded by a housing opaque to X-radiation, said window means being positioned relative to said second surface of said target and oriented thereto at an angle of approximately 80° to 85° for passing radiation emitted from said second surface of said target in a direction approximately 80° to 85° relative to a normal of said second surface, said housing of said window means being positioned relative to said target for inhibiting the passage of X-radiation emitted at an angle outside the range of approximately 80° to 85° relative to a normal of said second surface of said target, thereby providing a higher percentage of fluorescent X-ray lines relative to the entire spectrum of the emitted X-radiation.

2. A generator according to claim 1 wherein said second surface of said target is in the form of a cone.

3. A generator according to claim 2 wherein the apex portion of said cone is involuted towards an interior portion of the region enclosed by said cone.

* * * * *